United States Patent [19]

Murray

[11] 4,202,063

[45] May 13, 1980

[54] PATIENT LIFTING DEVICE

[76] Inventor: James B. Murray, P.O. Box 145, 301 E. Kalamazoo St., Bloomingdale, Mich. 49026

[21] Appl. No.: 932,011

[22] Filed: Aug. 8, 1978

[51] Int. Cl.[2] ..... A61G 1/02; A61H 1/02

[52] U.S. Cl. ..... 5/81 R; 5/89; 128/25 R

[58] Field of Search ..... 5/81 R, 81 B, 83, 84, 5/86, 87, 89; 128/25 R

[56] References Cited

U.S. PATENT DOCUMENTS

| | | | |
|---|---|---|---|
| 2,688,410 | 9/1954 | Nelson | 5/86 |
| 3,205,512 | 9/1965 | Camper | 5/86 |
| 3,230,553 | 1/1966 | Schlaskman et al. | 5/86 |
| 3,351,959 | 11/1967 | Turpin | 5/89 |
| 3,877,421 | 4/1975 | Brown | 5/81 B |
| 3,940,808 | 3/1976 | Petrini | 5/89 |
| 4,070,721 | 1/1978 | Stasko | 5/86 |

*Primary Examiner*—Casmir A. Nunberg
*Attorney, Agent, or Firm*—Blanchard, Flynn, Thiel, Boutell & Tanis

[57] ABSTRACT

A hollow beam is supported in cantilever fashion at one end on a frame and has laterally spaced rail flanges along its lower edges. A carriage has rollers on each corner which are supported on the rail flanges. A cable drum extends longitudinally of the carriage and is rotatable relative to the carriage. A shaft having a square cross section extends through the drum and the carriage and is rotatably supported at its ends by the beam. Rollers at each end of the drum and transverse to the shaft roll along the sides of the shaft. A motor mounted on the frame is connected to rotate the shaft and the drum thereon. A cable wound on the drum is connected to the center of a rigid hanger. Flexible suspension cables of equal length hang from the ends of the hanger and connect to the corners of a rectangular seat frame. A flexible side, back, neck and head panel has side edges anchored along the suspension cables connected to the front corners of the seat frame, and has tubular guides anchoring the rear edges of the side panel in isosceles relation to the cables at the front corners of the seat. Side strips from the neck and head supporting portions of the panel lap the rear cables and are anchored along their front edges to the front cables.

8 Claims, 9 Drawing Figures

PATIENT LIFTING DEVICE

FIELD OF THE INVENTION

This invention relates to an invalid hoist and, more particularly, to an invalid hoist having a cable drum located inside of an elongated and hollow beam and a patient receiving seat or harness suspended from the cable drum.

BACKGROUND OF THE INVENTION

Invalid hoists for lifting incapacited persons from a bed and transferring them in a sitting position to other supports are old, as in U.S. Pat. Nos. 3,877,421 to Brown, 3,351,959 to Turpin, 2,688,410 to Nelson, and 1,971,294 to Bunker. The present invention is an improvement over these and other prior patents in that the lifting drum is substantially enclosed in a hollow cantilever beam which supports the drum in selectively adjustable positions along the length of the beam. Also, the drive motor for rotating the drum is enclosed in the upper portion of the frame which supports the beam. The patient receiving seat or harness which supports the patient is also a novel improvement in that a single spreader or hanger bar and laterally spaced pairs of cables function to first lift a back and head supporting portion of the harness to angular relation with respect to a seat and leg supporting portion; and to thereafter lift both parts of the harness at the same time. The mechanical construction of the hoist is thus simplified and its cost is reduced while its operation is improved.

BRIEF DESCRIPTION OF THE DRAWINGS

The drawings, of which there are three sheets, illustrate a preferred form of the hoist and its method of operation.

FIGS. 7, 8 and 9 are side elevational views showing the harness in progressive lifting positions relative to the body of a patient shown in dotted lines, wherein FIG. 7 shows the patient in full reclining position, FIG. 8 shows the patient partially raised toward sitting position, and FIG. 9 shows the patient in fully supported sitting position.

DETAILED DESCRIPTION

Figure 1:
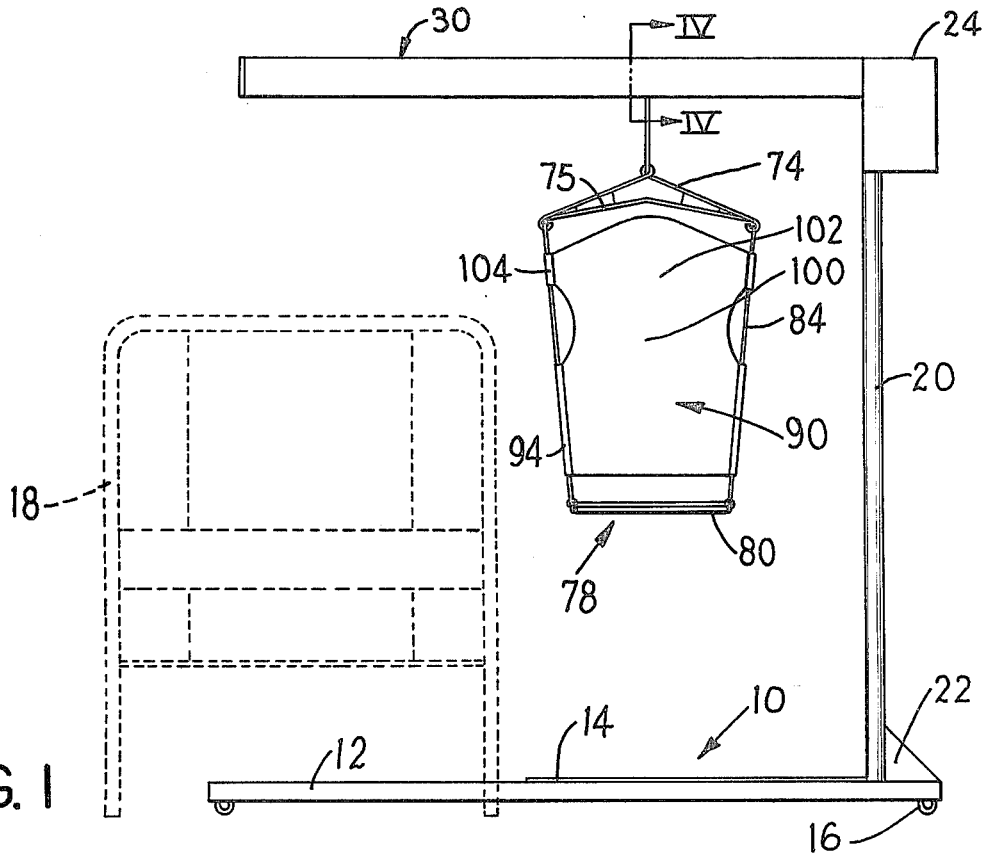
FIG. 1 is an end elevational view of the hoist in relation to a patient bed, shown in dotted lines.
Figure 2:
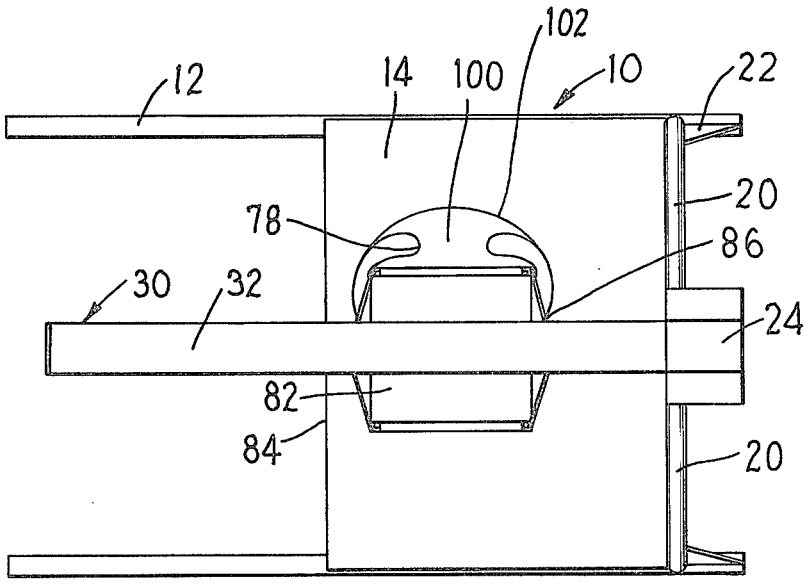
FIG. 2 is a top plan view of the hoist.
Figure 3:
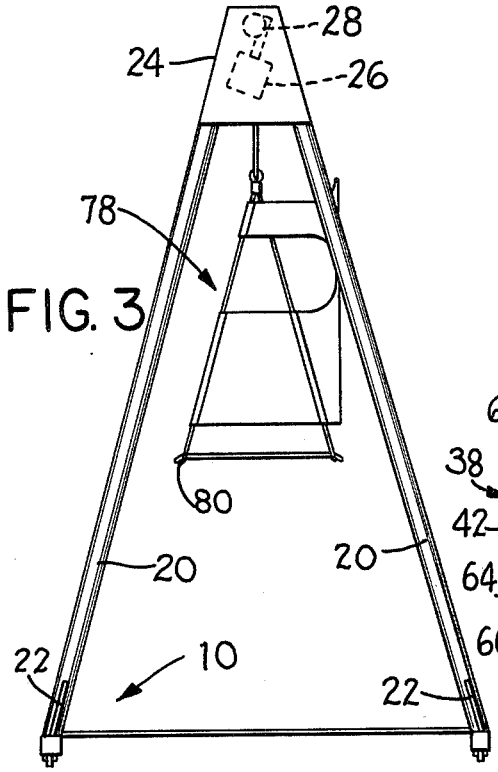
FIG. 3 is a side elevational view of the hoist.
Figure 4:
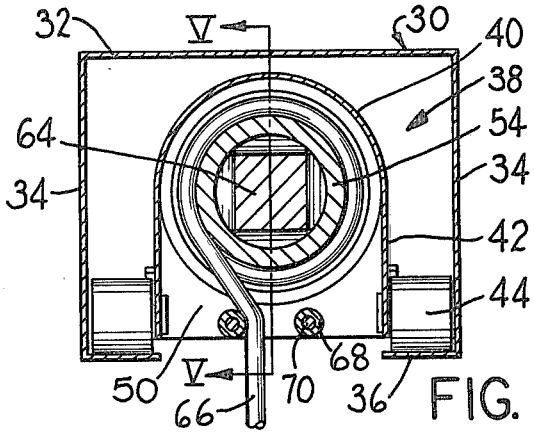
FIG. 4 is a fragmentary cross sectional view of the supporting boom of the hoist taken along the plane of the line IV—IV in FIG. 1 and looking in the direction of the arrows.
Figure 5:
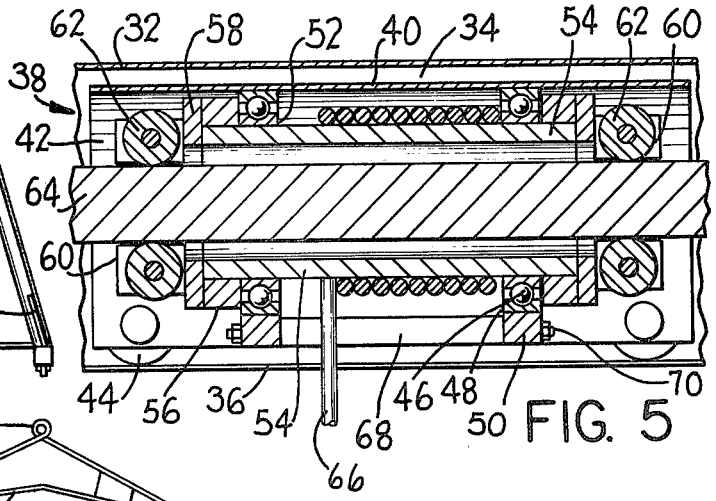
FIG. 5 is a fragmentary cross sectional view of the boom taken along the plane of the line V—V in FIG. 4 and looking in the direction of the arrows.
Figure 6:
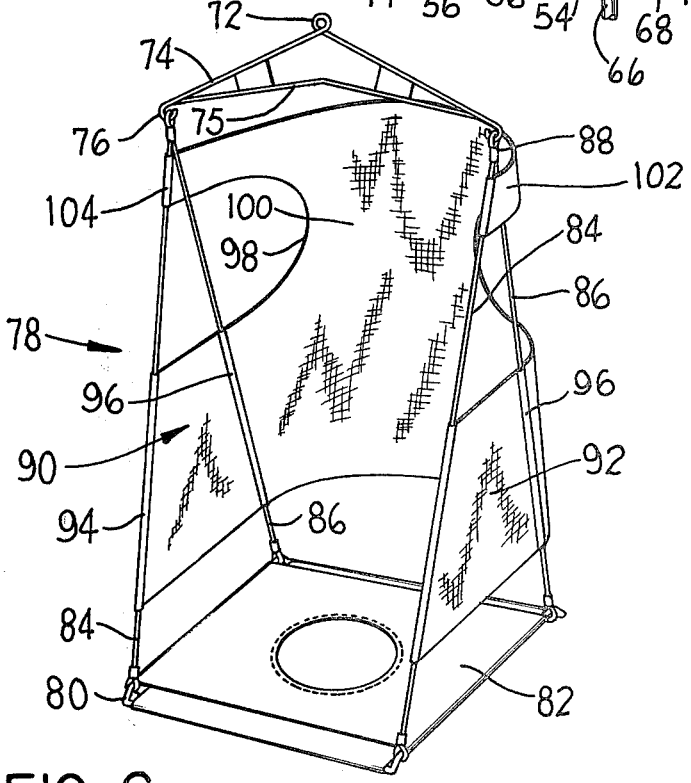
FIG. 6 is a perspective view of the patient supporting harness or seat of the hoist.

The hoist comprises a low, flat base generally indicated at 10 and including end rails 12 joined by a platform 14. The rails have casters or rollers 16 by means of which the base may be rolled under a patient's bed shown in phantom at 18. The terms end, side, front and back are oriented relative to the bed, with the foot of the bed considered as the front. An upright support frame consisting of upwardly converging struts or posts 20 is secured to one end of the base with the connections between the posts and the rails reinforced by gusset plates 22. The upper ends of the posts are connected by the walls of a box 24 of truncated triangular shape which forms an enclosure for a drive motor 26 and driving worm and gear 28 shown by dotted lines in FIG. 3.

A beam indicated generally at 30 projects in cantilever fashion from its supported end on the front side of the box 24. The beam is hollow, having a top wall 32 with front and rear side walls 34 and inwardly turned flanges 36 on the bottoms of the side walls folded from a single panel. The flanges 36 form rails or supporting guides for a carriage indicated generally at 38.

The carriage 38 consists of a downwardly opening U-shaped body panel 40 with depending parallel side walls 42. Rollers 44 are mounted on the lower edges of the side walls and are rollingly supported on the rails 36. Spaced inwardly from each end of the body panel are roller bearings 46 having their outer races 48 centered in the body panel. Upwardly opening saddle members 50 connected between the side walls 42 support the bearings in the body panel. The inner races 52 of the bearings are engaged around a cylindrical core or hub member 54 which forms the rotating part of a cable drum. Spacer rings 56 around the ends of the hub or core reinforce the connections of flat annular end rings 58 to the ends of the core. The end rings each support four roller support brackets 60, which in turn rotatably support four rollers 62 in diametrically spaced relation around the core and end rings. The rollers 62 project inwardly from the inner surfaces of the core and end rings and rollingly engage the four sides of a square drive shaft 64.

The drive shaft 64 has its ends supported by suitable bearings (not illustrated) at the outer and inner ends of the beam 30. At its inner end, the shaft is drivingly connected by the previously described worm and gear 28 to the motor 26. A hoisting cable 66 is wound around the drum or core with its running end directed downwardly between two elongated guide rollers 68 which are supported by bolts 70 between the saddle members 50.

It will be apparent that the carriage 38 may be moved to any position along the beam 30 and the shaft 64 with the carriage rollers 44 supported on the flange rails 36, and with the core rollers 62 supported on the sides of the shaft 64. In any of the adjusted positions of the carriage, the shaft 64 may be rotated by the motor 26 and worm and gear 28 to pay out the end of the cable 66 or take the cable in. The end of the cable connects to a center eye 72 of a rigid hanger arm 74.

Hooks 76 on the ends of the hanger arm releasably engage and support a patient supporting seat or harness indicated generally at 78. It is especially pointed out that the lower cross bar 75 of the arm 74 is bowed upwardly in the middle to span the neck and chest of a patient when the arm is connected to the harness, as will be described presently. The harness 78 comprises a rectangular frame 80 with a seat panel 82 connected to the side parts of the frame. Two pairs of flexible cables are connected between the corners of the seat frame and the hooks 76 with a front cable 84 and a rear cable 86 in each pair. Preferably the cables are of equal length and may be formed from a single length of cable looped at the middle to form a suspension eye 88. Note that lengthening the loop which forms the eye 88 can eliminate the need for bowing the lower bar 75 of the arm 74.

A body and head support panel of strong fabric is indicated generally at 90. The panel has side portions 92 which are formed or defined by upwardly converging tubular loops 94 and 96 through which the cables 84 and 86 are threaded. The converging loops prevent the side panels from sliding down beyond a predetermined level along the cables. Above the side panels, loops or notches 98 are cut from the panel to define a narrow neck supporting panel 100 and an upper head supporting strap 102. The forward edges of the strap 102 are stitched into tubular loops 104 and the front cables 84 are threaded through these loops. The forward ends of the head straps are lapped along the outer sides of the rear cables 86, so the height of the head strap may be adjusted along the front cables.

Figure 7:
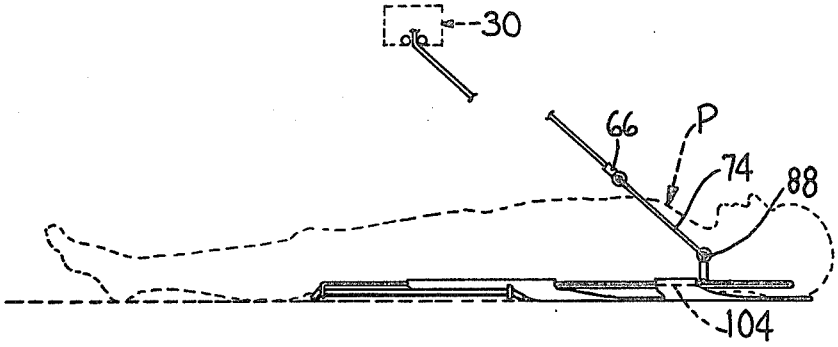
Figure 8:
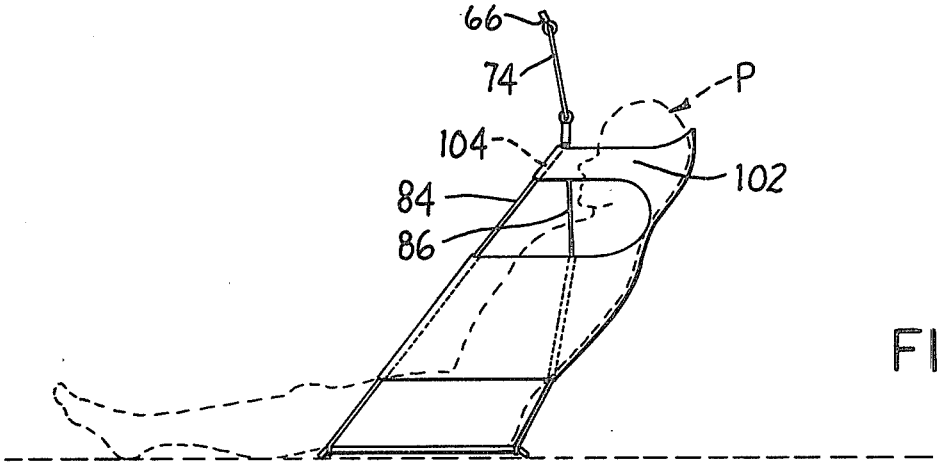
Figure 9:
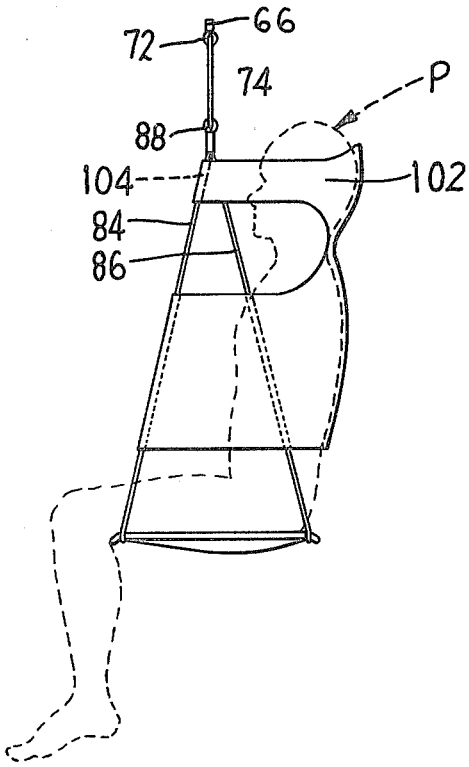

As is shown in FIGS. 7, 8 and 9, the seat or harness may be folded flat on a bed and the patient P lifted or rolled onto it, with the forward edge of the seat frame under the patient's knees. In this position the eyes 88 of the suspension cables lie between the shoulders and head of the patient.

Next, as shown in FIG. 7, the hanger arm 74 may be lowered to engage the hooks 76 with the eyes 88. Note that the hoist can be positioned as indicated in FIG. 7 over the patient's waist to locate the hanger arm in a position where upward movement of the hanger arm will first apply a lifting motion of the head supporting portion or strap 102 of the harness panel. As the head strap and neck support portion 100 raise the head and neck of the patient, the pull or lift on the arm 74 is moved forwardly as shown in FIG. 8, thus progressively applying lifting force to the back of the patient through loops 94 and 96. When the upper torso of the patient approaches an upright position, the tension in cables 84 and 86 is equalized and further lifting by the cable 66 and arm 74 raises the patient in sitting position and with the knees bent as in FIG. 9.

Note that the changes in the point of application of the lifting force of the cable 66 are achieved automatically by the geometry of the harness 78. The first lifting force applied to the head and neck of the patient is applied through the stitched tubes 104 and head strap 102 with the weight of the patient on the seat 82 and back support portion 100 of the harness preventing any movement of the remainder of the harness. The initial lift of hooks 76 and loops 88 eventually results in a progressively larger tension applied along front cables 84 until the tension in the cables is approximately equalized under the hanger 74 in the vertical position. The weight or rearward pressure of the head will then have relatively little effect on the main supporting cables as shown in FIG. 9.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an invalid hoist including:

a beam projecting in cantilever relation from an upright post supported on a base in spaced relation below the beam, said beam being formed of a sheet metal panel of a generally box shaped section having a top wall, spaced side walls and spaced apart inturned rail flanges on the lower edges of said side walls;

a carriage longitudinally movably supported within said beam;

a lifting cable having a free end depending from said carriage; and a patient supporting harness connected to the free end of said cable, wherein the improvement comprises:

a rotatable tubular drum substantially enclosed inside said beam, said beam supporting said rotatable drum for longitudinal movement therewithin;

said beam enclosing therewithin said lifting cable wound on said drum, said lifting cable having its free end exiting from said beam downward between said inturned rail flanges;

a noncircular cross section shaft enclosed within said beam and rotatably supported at its ends by said cantilevered beam, said carriage supporting said drum for rotation with respect thereto and for said longitudinal movement of said drum within said beam;

means movable with said carriage along said beam and connected to said drum to engage the noncircular parts of said shaft to rotate said drum with said shaft; and power means mounted on the end of said upright and drivingly connected to said shaft.

2. An invalid hoist as defined in claim 1, wherein said carriage includes a body comprising a U-shaped plate with downwardly extending sides, and rollers connected to the lower edges of said sides and supported on said rail flanges;

antifriction bearings having their inner races engaged around the ends of said drum and their outer races engaged in the U-shape of said plate; and other rollers connected to the ends of said drum and having axes transverse to the axis of the drum;

said shaft having flatted sides engaged with the peripheries of said other rollers, whereby the other rollers and said drum rotate with said shaft, said drum extending longitudinally of said carriage and said beam, said lifting cable being connected to said drum to be payed out and taken in by rotation of said drum.

3. An invalid hoist as defined in claim 1, wherein said upright post includes:

two struts converging upwardly from said base to said beam; and a housing connecting the converging ends of said struts and the end of said beam with said power means being enclosed in said housing; and wherein said power means includes a motor with a worm on its shaft drivingly engaged with a gear on the end of the shaft within said beam.

4. An invalid hoist as defined in claim 3 in which said base extends laterally in one direction from the bottom of said upright and is low, to permit sliding of its free end portion beneath a bed, a low flat platform covering said base in the approximate one half thereof closest to said upright and furthest from said free end.

5. An invalid hoist including:

a beam projecting in cantilever relation from an upright post supported on a base in spaced relation below the beam, the beam being of hollow cross section having a top wall, spaced side walls and spaced apart inturned rail flanges on the lower edges of said side walls;

a carriage longitudinally supported within said beam;

a rotatable tubular drum substantially enclosed inside said beam, said carriage supporting said rotatable drum for longitudinal movement within said beam;

a lifting cable wound on said drum and having a free end depending from said carriage and exiting downward from said beam;

a noncircular cross section shaft received in rotative driving relation through said drum and power means connected to said shaft for driving same to lift and lower said cable with respect to said beam; and a patient supporting harness, wherein the patient supporting harness comprises:

a spreader arm having hooks on its ends and connected at its center to said cable;

a relatively rigid seat having four connection points at its corners;

a pair of front and rear cables on each side of said seat and converging upwardly from said connecting points at said corners, with eyes at the upper ends of the cables removably connected to the hooks on said arm; and a fabric panel having side portions connected between converging portions of said pairs of cables and back and head portions extending between said side portions and thereabove;

the side edges of said head portion having straps extending forwardly in lapped relation to said rear cables and connected to said front cables.

6. An invalid hoist as defined in claim 5, wherein said fabric panel has notches cut away in its side edges between said side portions and head portion, and defining a neck supporting portion therebetween.

7. An invalid hoist having a beam adapted to be positioned in spanning relation above a bed and supported from a movable base;

a carriage supported on said beam and movable therealong;

a drum rotatably mounted on said carriage and having a lifting cable wrapped therearound;

means for rotating said drum;

a spreader arm connected to the free end of said cable near the center of this arm and having connecting points at each end;

A patient harness comprising:

a relatively rigid rectangular seat with connecting points at each corner;

pairs of suspension cables connected to said seat on each side, the cables of each pair extending above the seat in converging relation to common connecting points removably connectible to the connecting points on the ends of said spreader arm; and a supporting fabric panel having flexible side portions and back, neck and head supporting portions, said side portions having front and rear edges converging upwardly and substantially continuously secured along said cables of said pairs, each of said side portions extending snugly between said convergent pair of cables at each side, said flexible back supporting portion extending loosely between the rear edges of said side portions at the rear ones of said cables, a neck supporting portion extending upwardly from and substantially narrowed from said back portion and having side edges rearwardly spaced from said cables by windows, and a flexible head supporting portion connected to the top of said back portion and widened by side head strips extending forwardly in lapped relation to the rearmost of said pairs of suspension cables with the forward edges of the strips anchored to the forward suspension cables.

8. An invalid hoist as defined in claim 7, wherein the connections between said suspension cables and said fabric panel are formed by integral tubular folds formed in the fabric of the panel and engaged around the cables.

* * * * *